United States Patent [19]

White

[11] Patent Number: 5,074,412

[45] Date of Patent: Dec. 24, 1991

[54] MULTIPLE COMPARTMENT BOX FOR SMOKING ARTICLES

[75] Inventor: Marie B. White, Louisville, Ky.

[73] Assignee: Brown & Williamson Tobacco Corporation, Louisville, Ky.

[21] Appl. No.: 542,147

[22] Filed: Jun. 22, 1990

[51] Int. Cl.[5] ..... B65D 85/10; B65D 25/04; A24F 15/00

[52] U.S. Cl. ..... 206/256; 206/261; 206/268; 229/120.03; 229/120.32; 229/160.1

[58] Field of Search ..... 206/251, 256–258, 206/261–265, 267, 269, 270, 268; 229/87.13, 120.03, 120.32, 121, 125.01, 125.19, 146, 160.1

[56] References Cited

U.S. PATENT DOCUMENTS

| | | | |
|---|---|---|---|
| 727,600 | 5/1903 | Doscher | 206/256 X |
| 1,104,529 | 7/1914 | Mendelson et al. | 206/256 |
| 1,112,752 | 10/1914 | AveManal | 206/256 |
| 1,158,826 | 11/1915 | Mendelson | 206/256 X |
| 1,929,148 | 10/1933 | Molins et al. | 206/256 |
| 2,420,031 | 5/1947 | Cohn | 206/270 X |
| 2,983,424 | 5/1961 | Glass | 206/256 X |
| 3,007,623 | 11/1961 | Clemens | 229/120.03 |
| 3,039,671 | 6/1962 | Chiamardas | 206/256 X |

FOREIGN PATENT DOCUMENTS

| | | | |
|---|---|---|---|
| 11617 | 7/1915 | United Kingdom | 206/258 |
| 448580 | 6/1936 | United Kingdom | 206/256 |

*Primary Examiner*—Bryon P. Gehman

*Attorney, Agent, or Firm*—Charles G. Lamb; James C. Eaves, Jr.

[57] ABSTRACT

A box for smoking articles having closures at both the top and bottom of the box. The box is provided with a divider substantially midway of the box dividing the box into two compartments. The divider is transversely disposed between front, back, and side panels of the box. Smoking articles are disposed on opposite sides of the divider. Cigarettes contained in the box would be about one-half the length of the box, each cigarette in one compartment of the box being in axial alignment with a cigarette in the other compartment, wherein one-half of the smoking articles are removable through the top closure and the other half are removable through the bottom closure.

24 Claims, 3 Drawing Sheets

MULTIPLE COMPARTMENT BOX FOR SMOKING ARTICLES

BACKGROUND OF THE INVENTION (a) Field of the Invention

The present invention relates to a box for smoking articles. The present invention particularly relates to a divider separating the box into two compartments for smoking articles, the divider being transversely disposed between the front, back, and side panels of the box. Even more particularly, the present invention relates to a box for smoking articles wherein one-half of the smoking articles are removed from the box at the top and one-half of the smoking articles are removed at the bottom.

(b) Description of the Prior Art

Various boxes including cigarettes therein which are relevant to the present invention are well known in the prior art. For example, Deutsches Bundespatent DT 2702-234, provisional publication date of July 27, 1978, teaches a cigarette having a weakened zone in the center of the cigarette and thereby being designed for separation into two pieces.

U.S. Pat. No. 3,007,623 teaches a dual cigarette pack, wherein the pack is divided lengthwise into two compartments for holding two different full-length cigarettes. The cigarette pack divider is transversely disposed between the front and back panels of the cigarette pack, but is parallel to the side panels. The pack contains two lids, both of which open at the same end of the pack.

U.S. Pat. No. 2,983,424 also teaches a dual cigarette box which is divided lengthwise into two compartments for holding two different full-length cigarettes. The cigarette box divider is transversely disposed between the front and back panels of the cigarette box, but is parallel to the side panels. In addition to having both lids open at the same end of the pack, this reference also teaches having one lid open at one end of the pack and the other lid open at the other end of the pack.

SUMMARY OF THE INVENTION

The present invention is for a box for smoking articles wherein the box is divided into two compartments, each compartment containing smoking articles which are approximately one-half the length of the box. Furthermore, the box is openable at either closure to remove smoking articles from each compartment.

More particularly, the present invention is for a box for smoking articles comprising: a front panel, a back panel, opposed side panels attached to opposite longitudinal sides of said front and back panels, a pair of openings defined by the attachment of said front, back, and side panels, opposed closures for selectively closing said openings, and a divider substantially midway of said box transversely disposed between said front, back, and side panels.

BRIEF DESCRIPTION OF THE DRAWINGS

A better understanding of the present invention will be had upon reference to the following description in conjunction with the accompanying drawings wherein.

DETAILED DESCRIPTION OF THE PREFERRED EMBODIMENT

Figure 1:
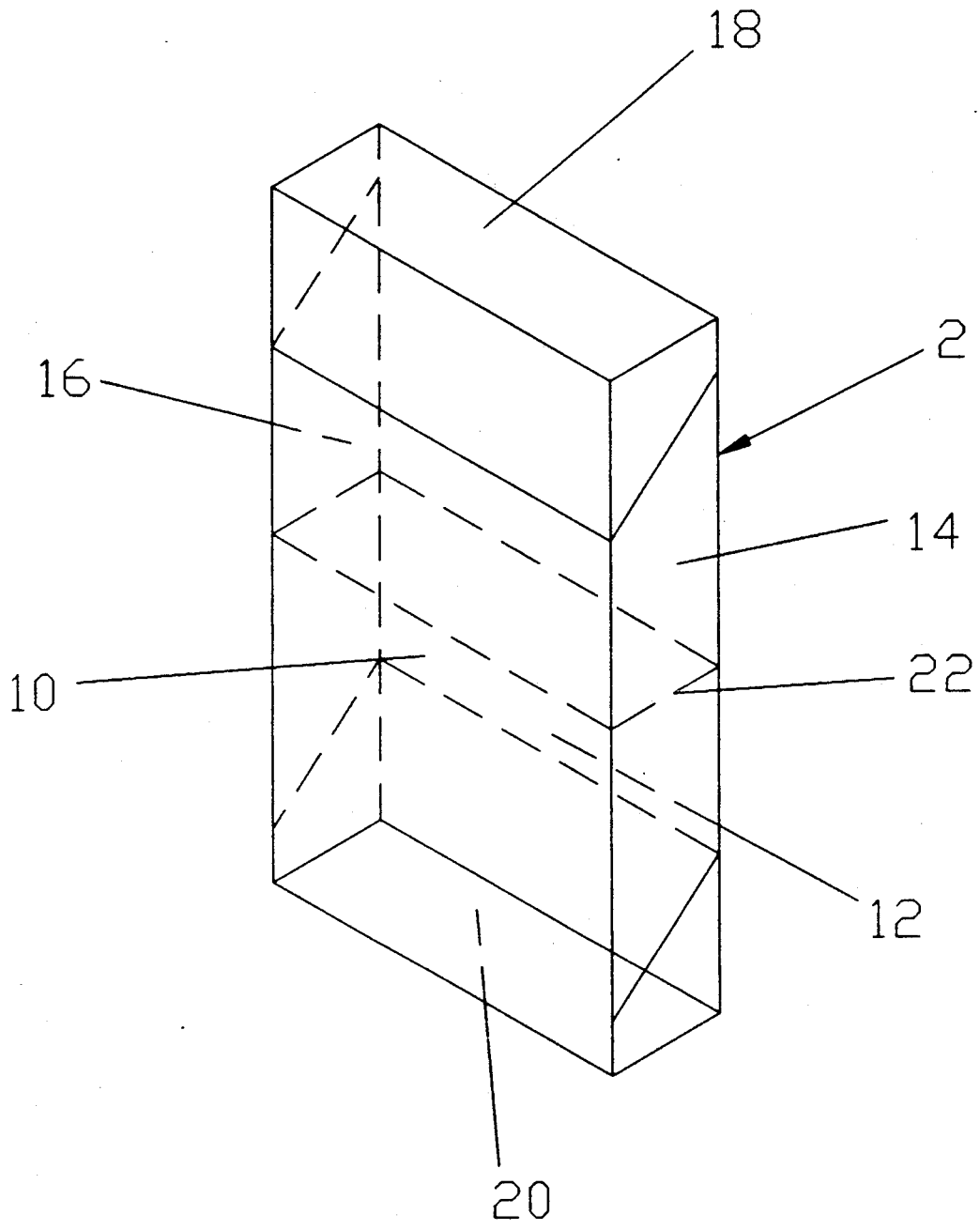
FIG. 1 is a perspective view of the box of the present invention showing the top flip open closure hingedly attached to the back panel of the box and the bottom flip open closure hingedly attached to the front panel of the box.
Figure 2:
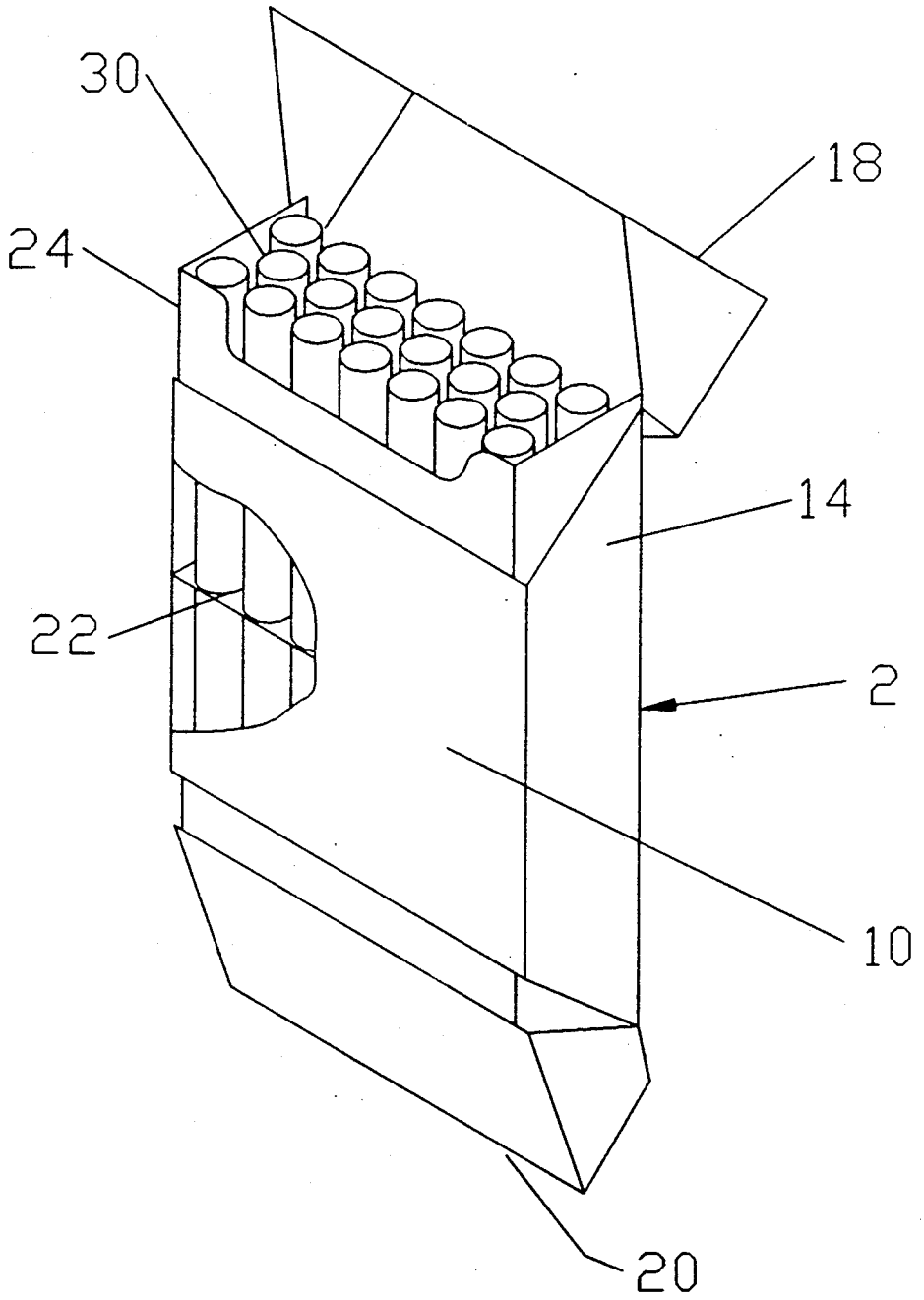
FIG. 2 is a perspective view of the box of the present invention containing smoking articles, the box having an inner housing and having both closures hingedly attached to the box back panel; the box is shown with one closure open and the other closure partially open; a cut away shows the box divider and the smoking articles.

With reference to FIGS. 1 and 2, there is shown a box 2 for smoking articles. The box 2 contains a front panel 10, a back panel 12, and opposed side panels 14 and 16 attached to opposite longitudinal sides of said front panel 10 and back panel 12. The box 2 also includes opposed flip open lids 18 and 20 for selectively closing the openings defined by the attachment of said front panel 10, back panel 12, and side panels 14 and 16. Flip open lid 18 is located at the top of the box 2 and flip open lid 20 is located at the bottom of the box 2. A divider 22, substantially midway of said box transversely disposed between said front panel 10, back panel 12, and side panels 14 and 16, is also provided.

These components of the box 2 for smoking articles may be made out of any material suitable for a cigarette box, such as, for example, cardboard, paper, or plastic. The divider 22 can be attached to the box by any conventional method, such as, for example, gluing.

FIG. 1 shows the box 2 for smoking articles with flip open lid 18 being hingedly attached to back panel 12 and flip open lid 20 being hingedly attached to front panel 10. FIG. 2 includes the same elements and common numeral designations as FIG. 1, except both flip open lids 18 and 20 are hingedly attached to the back panel 12. Moreover, the design of the lids 18 and 20 is a right trapezoidal polyhedron.

FIG. 2 also shows the inclusion of an inner housing 24 including the means to prevent distortion of the box when at least one of the flip open lids is in a closed position. The inner housing 24 is also constructed of material known to those skilled in the art, such as, for example, cardboard, paper, or plastic. Furthermore, the divider 22 may be integral with the inner housing 24.

In FIG. 2, it is also shown that smoking articles 30 may be placed in compartments defined by the divider 22 and the flip top lids 18 and 20. The smoking articles may be any smoking article, either filter or nonfilter. In the preferred embodiment, the box will contain 40 smoking articles, 20 articles in each compartment, and each article will have a length of about 40 mm to 60 mm. Thus, the box will have a length of about 80 mm to 120 mm, which is the standard size of commercially available products having a standard 20 cigarettes therein. The cut-away shows the divider 22 and smoking articles 30.

Figure 3:
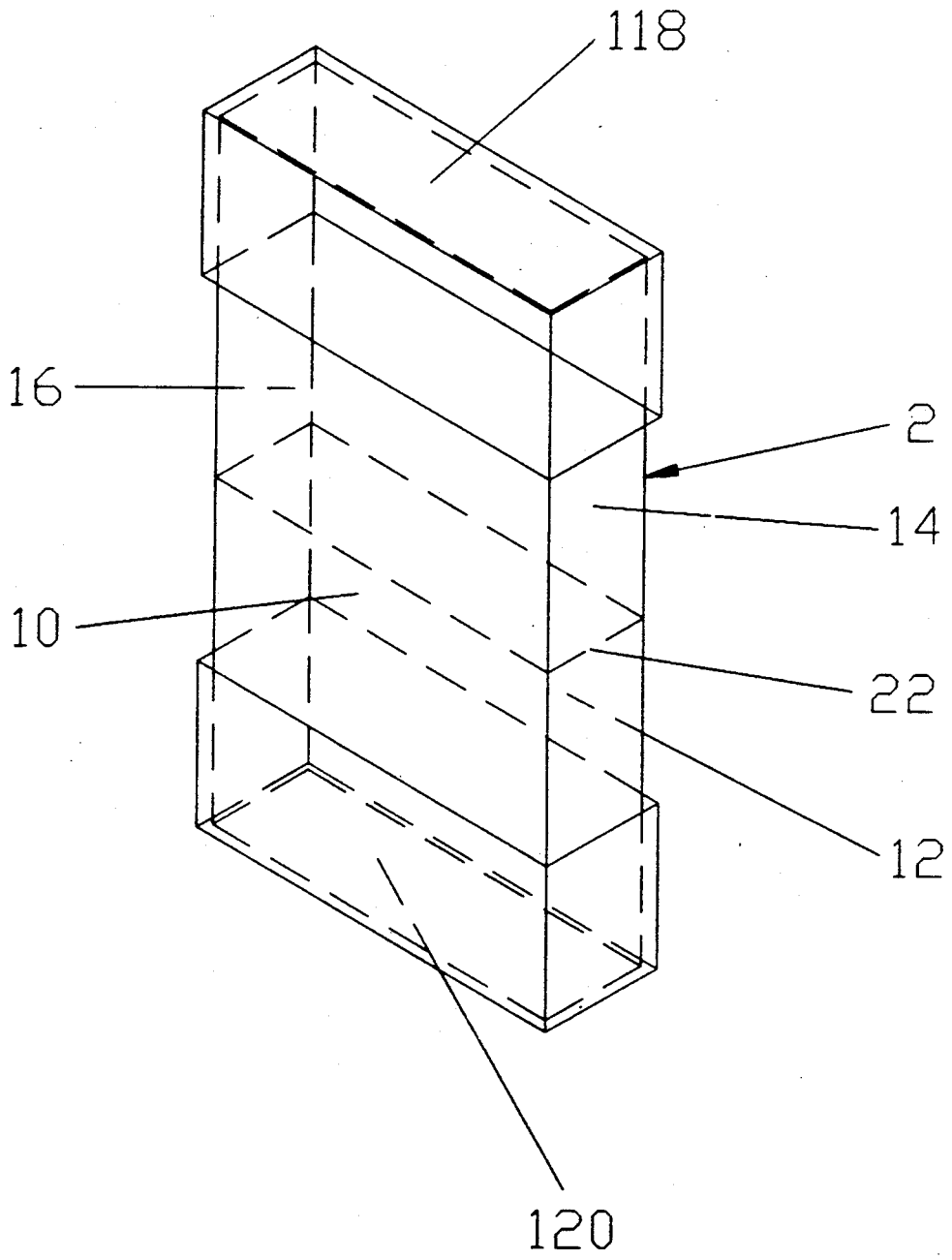
FIG. 3 is a perspective view of the box of the present invention showing detachable slipover closures.

FIG. 3 shows a similar box to that of FIGS. 1–2, but flip open lids 18 and 20 have been replaced with slipover closures 118 and 120. The slip over closures 118 and 120 are removable from the box in order to remove smoking articles therefrom. Slip over closures 118 and 120 are also constructed of material known to those skilled in the art, such as, for example, cardboard, paper, or plastic.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. A box containing smoking articles comprising: a front panel, a back panel, opposed side panels attached to opposite longitudinal sides of said front and back panels, a top opening and a bottom opening defined by the attachment of said front, back and side panels, opposed closures for selectively closing said openings, a divider substantially midway of said box integrally joined to and transversely disposed between said front, back and side panels, and transverse to the axis of each smoking article, said divider dividing said box into two smoking article compartments, a top compartment and a bottom compartment, each of said compartments including smoking articles therein, said smoking articles being disposed parallel to said front, back, and side panels and said smoking articles in one compartment being substantially axially aligned with smoking articles in the other compartment, said smoking articles in said top compartment being removable only through said top opening and said smoking articles in said bottom compartment being removable only through said bottom opening.

2. The box of claim 1, wherein each compartment contains 20 filter cigarettes, each cigarette having a length of from about 40 mm to about 60 mm.

3. The box of claim 1, wherein each compartment contains 20 nonfilter cigarettes, each cigarette having a length of from about 40 mm to about 60 mm.

4. The box of claim 1, wherein said opposed closures are a pair of flip open lids, said flip open lids having the shape of a right trapezoidal polyhedron.

5. The box of claim 4, wherein said flip open lids are both hingedly attached to said back panel, said flip open lids cooperating with said side, front, and back panels to define a sealed container when said flip open lids are in a closed position.

6. The box of claim 5, wherein each compartment contains 20 filter cigarettes, each cigarette having a length of from about 40 mm to about 60 mm.

7. The box of claim 5, wherein each compartment contains 20 nonfilter cigarettes, each cigarette having a length of from about 40 mm to about 60 mm.

8. The box of claim 5, wherein said front, back, and opposed side panels define an outer housing, said box including an inner housing, said inner housing including means to prevent distortion of said box when at least one of said flip open lids is in a closed position.

9. The box of claim 8, wherein each compartment contains 20 filter cigarettes, each cigarette having a length of from about 40 mm to about 60 mm.

10. The box of claim 8, wherein each compartment contains 20 nonfilter cigarettes, each cigarette having a length of from about 40 mm to about 60 mm.

11. The box of claim 4, wherein one flip open lid is hingedly attached to said back panel and the other flip open lid is hingedly attached to said front panel.

12. The box of claim 11, wherein each compartment contains 20 filter cigarettes, each cigarette having a length of from about 40 mm to about 60 mm.

13. The box of claim 11, wherein each compartment contains 20 nonfilter cigarettes, each cigarette having a length of from about 40 mm to about 60 mm.

14. The box of claim 11, wherein said front, back, and opposed side panels define an outer housing, said box including an inner housing, said inner housing including means to prevent distortion of said box when at least one of said flip open lids is in a closed position.

15. The box of claim 14, wherein each compartment contains 20 filter cigarettes, each cigarette having a length of from about 40 mm to about 60 mm.

16. The box of claim 14, wherein each compartment contains 20 nonfilter cigarettes, each cigarette having a length of from about 40 mm to about 60 mm.

17. The box of claim 4, wherein said front, back, and opposed side panels define an outer housing, said box including an inner housing, said inner housing including means to prevent distortion of said box when at least one of said flip open lids is in a closed position.

18. The box of claim 17, wherein each compartment contains 20 filter cigarettes, each cigarette having a length of from about 40 mm to about 60 mm.

19. The box of claim 17, wherein each compartment contains 20 nonfilter cigarettes, each cigarette having a length of from about 40 mm to about 60 mm.

20. The box of claim 4, wherein each compartment contains 20 filter cigarettes, each cigarette having a length of from about 40 mm to about 60 mm.

21. The box of claim 4, wherein each compartment contains 20 nonfilter cigarettes, each cigarette having a length of from about 40 mm to about 60 mm.

22. A box containing smoking articles comprising: a front panel, a back panel, opposed side panels attached to opposite longitudinal sides of said front and back panels, a top opening and a bottom opening defined by the attachment of said front, back and side panels, opposed detachable slipover closures for selectively closing the openings, a divider substantially midway of said box integrally joined to and transversely disposed between said front, back, and side panels, and transverse to the axis of each smoking article, said divider dividing said box into two smoking articles compartments, a top compartment and a bottom compartment, each of said compartments including smoking articles therein, said smoking articles being disposed parallel to said front panel, said back panel, and said side panels and, said smoking articles in one compartment being substantially axially aligned with smoking articles in the other of said compartments, said smoking articles in said top compartment being removable only through said top opening and said smoking articles in said bottom compartment being removable only through said bottom opening.

23. The box of claim 22, wherein each compartment contains 20 filter cigarettes, each cigarette having a length of from about 40 mm to about 60 mm.

24. The box of claim 22, wherein each compartment contains 20 nonfilter cigarettes, each cigarette having a length of from about 40 mm to about 60 mm.

* * * * *